US011286810B2

(12) United States Patent
Hilleke et al.

(10) Patent No.: US 11,286,810 B2
(45) Date of Patent: Mar. 29, 2022

(54) OUTFLOW HOUSING OF A STEAM TURBINE

(71) Applicant: Siemens Energy Global GmbH & Co. KG, Munich (DE)

(72) Inventors: Robert Hilleke, Kodersdorf (DE); Stefan Preibisch, Görlitz (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 448 days.

(21) Appl. No.: 16/326,447

(22) PCT Filed: Jul. 4, 2017

(86) PCT No.: PCT/EP2017/066556

§ 371 (c)(1),
(2) Date: Feb. 19, 2019

(87) PCT Pub. No.: WO2018/036697

PCT Pub. Date: Mar. 1, 2018

(65) Prior Publication Data

US 2021/0277801 A1 Sep. 9, 2021

(30) Foreign Application Priority Data

Aug. 23, 2016 (DE) ..... 10 2016 215 770.1

(51) Int. Cl.
*F01D 25/24* (2006.01)
*F01D 11/00* (2006.01)

(52) U.S. Cl.
CPC ..... *F01D 25/24* (2013.01); *F01D 11/003* (2013.01); *F01D 11/005* (2013.01); *F05D 2220/31* (2013.01); *F05D 2240/55* (2013.01)

(58) Field of Classification Search
CPC ..... F01D 25/24; F01D 11/003; F01D 11/005; F05D 2220/31; F05D 2240/55
See application file for complete search history.

(56) References Cited

U.S. PATENT DOCUMENTS 6,074,169 A * 6/2000 Siga ..... C22C 38/001 415/200
6,267,556 B1 * 7/2001 Kikuchi ..... F01D 25/243 415/176

(Continued)

FOREIGN PATENT DOCUMENTS

CN 1442603 A 9/2003
CN 1880732 A 12/2006

(Continued)

OTHER PUBLICATIONS

PCT International Search Report and Written Opinion of International Authority dated Sep. 15, 2017 corresponding to PCT International Application No. PCT/EP2017/066556.

(Continued)

*Primary Examiner* — Shafiq Mian

(57) ABSTRACT

An outflow housing for a turbine section of a steam turbine. The outflow housing has an outflow housing wall, which surrounds a central drum chamber along a housing longitudinal axis, and a connection interface for connecting the outflow housing to a turbine housing of the steam turbine. A sealing device for sealing an end of the outflow housing, which end is arranged at the rear in the flow direction, with respect to a turbine shaft of the steam turbine is arranged on the outflow housing wall, wherein the sealing device is sealed to the outflow housing wall. A steam turbine has the outflow housing herein.

10 Claims, 3 Drawing Sheets

(56) References Cited

U.S. PATENT DOCUMENTS

| | | | | |
|---|---|---|---|---|
| 9,631,514 | B2 * | 4/2017 | Onoda | F01D 11/025 |
| 10,240,485 | B2 | 3/2019 | Grussmann | |
| 2003/0143069 | A1 * | 7/2003 | Kitazawa | C22C 38/18 415/199.5 |
| 2004/0175262 | A1 * | 9/2004 | Burdgick | F01D 11/005 415/111 |
| 2005/0039333 | A1 | 2/2005 | Wechsung | |
| 2006/0024156 | A1 * | 2/2006 | Blatchford | F01D 11/18 415/170.1 |
| 2006/0292003 | A1 * | 12/2006 | Kriz | F01D 25/28 415/213.1 |
| 2010/0034641 | A1 * | 2/2010 | Ikeda | F01D 25/26 415/116 |
| 2010/0296923 | A1 | 11/2010 | Yamashita et al. | |
| 2012/0093641 | A1 * | 4/2012 | Chieco | F01D 25/26 415/213.1 |
| 2013/0170956 | A1 | 7/2013 | Almstedt et al. | |
| 2014/0212269 | A1 | 7/2014 | Kastner et al. | |
| 2015/0121898 | A1 | 5/2015 | Tashima et al. | |
| 2016/0215623 | A1 | 7/2016 | Assmann et al. | |

FOREIGN PATENT DOCUMENTS

| | | | |
|---|---|---|---|
| CN | 102444437 | A | 5/2012 |
| CN | 102518488 | A | 6/2012 |
| CN | 202900332 | U | 4/2013 |
| CN | 103097663 | A | 5/2013 |
| CN | 104487660 | A | 4/2015 |
| DE | 1426817 | A1 | 1/1969 |
| EP | 2101044 | A1 | 9/2009 |
| EP | 2151547 | A2 | 2/2010 |
| EP | 3026229 | A1 | 6/2016 |
| GB | 1077105 | A | 7/1967 |
| GB | 1335939 | A | 10/1973 |
| JP | H1089013 | A | 4/1998 |
| JP | 2010089013 | A | 4/2010 |
| JP | 2010255542 | A | 11/2010 |
| JP | 2011506810 | A | 3/2011 |
| JP | 2013053537 | A | 3/2013 |
| JP | 2016089806 | A | 5/2016 |
| RU | 2321757 | C2 | 4/2008 |
| WO | 9741335 | A1 | 11/1997 |
| WO | 0159264 | A1 | 8/2001 |
| WO | 2015043815 | A1 | 4/2015 |
| WO | 2018036697 | A1 | 3/2018 |

OTHER PUBLICATIONS

He A-Ping, et al; Ultra Supercritical 1000MW Steam Turbine with the "HMN" Modules Designed by STC and Siemens; Shanghai Turbine Company Ltd., Shanghai 200240, China.

* cited by examiner

OUTFLOW HOUSING OF A STEAM TURBINE

CROSS REFERENCE TO RELATED APPLICATIONS

This application is the US National Stage of International Application No. PCT/EP2017/066556 filed Jul. 4, 2017, and claims the benefit thereof. The International Application claims the benefit of German Application No. DE 10 2016 215 770.1 filed Aug. 23, 2016. All of the applications are incorporated by reference herein in their entirety.

FIELD OF INVENTION

The present invention relates to an outflow housing for a turbine section of a steam turbine with reheating. The present invention also relates to a steam turbine having an outflow housing according to the invention.

BACKGROUND OF INVENTION

Steam turbines are turbomachines which are designed to convert the enthalpy of steam into kinetic energy. Conventional steam turbines have a turbine housing which surrounds a flow chamber for the throughflow of the steam. A rotationally mounted turbine shaft having a multiplicity of rotor blades is arranged in the flow chamber, which rotor blades are held, in the form of rotor blade rings arranged in series, on the turbine shaft. To optimize the impingement of steam on the rotor blades, steam turbines have guide blade rings which are positioned upstream of in each case one rotor blade ring and which are held on the turbine housing. A group composed of a guide blade ring with associated rotor blade ring is also referred to as turbine stage.

As flow passes through the steam turbine, the steam releases a part of its inherent energy, which is converted by means of the rotor blades into rotational energy of the turbine shaft. Here, an expansion of the steam occurs, such that pressure and temperature of the steam are reduced after each turbine stage as the flow passes through the steam turbine. The turbine housing is thus exposed to a temperature gradient between a steam inlet and a steam outlet. In particular in the case of steam turbines of compact construction, this leads to a very high load on the turbine housing.

In specific embodiments, steam turbines have multiple turbine sections, such as for example a high-pressure section, a medium-pressure section and/or low-pressure section. To improve efficiency, it is possible for such steam turbines to have a heating device for reheating the steam, such that, for example, steam exiting the high-pressure section can be heated by the heating device before being fed to the downstream turbine sections. Provision may be made here for a heating device of said type to be arranged in each case between two turbine sections. In particular in the case of steam turbines with such reheating of the steam, intense temperature fluctuations arise along a turbine longitudinal axis of the steam turbine. The temperature firstly gradually falls in the high-pressure section, then abruptly increases in the transition region owing to the reheating. A region of the turbine housing which is arranged adjacent to an outflow of the high-pressure section and to an inflow of the following medium-pressure section or low-pressure section is, in particular in the case of steam turbines of compact construction, exposed to particularly large temperature differences.

Moreover, for the sake of better producibility and assemblability, turbine housings have multiple housing parts which are connected to one another, with the formation of parting joints, in order to form the turbine housing. Here, turbine housings often have a housing lower part and a housing upper part. Along the turbine longitudinal axis, too, the turbine housing may have multiple housing segments, such that the high-pressure section and the medium-pressure section are arranged for example in different housing segments. The connection is often realized by means of a screw connection of flanges of the housing parts or housing segments.

The greater a mechanical load on the connections to the housing parts or housing segments, the larger the fastening elements required to compensate the forces that open the parting joints. In particular in the case of steam turbines of compact construction, this constitutes a major problem, because an available structural space of the steam turbine is often greatly restricted. Load-bearing capabilities of such steam turbines are thus greatly restricted.

To accommodate the guide blades or guide blade rings, steam turbines have outflow housings which are arranged within the turbine housing coaxially with respect to the turbine longitudinal axis. In the case of steam turbines with reheating, a particularly intense temperature gradient arises in particular in the region of an outlet opening of the outflow housing on the turbine housing, because the steam exiting the outflow housing impinges directly on the turbine housing in this region. In the presence of an excessively large temperature gradient, the turbine housing may be damaged in particular in this critical region. For this reason, maximum levels of power of such steam turbines are greatly limited in order to avoid such large temperature gradients.

SUMMARY OF INVENTION

It is therefore an object of the present invention to create an outflow housing and a steam turbine which eliminate or at least partially eliminate the disadvantages of the prior art. In particular, it is the object of the present invention to provide an outflow housing and a steam turbine which, with simple means and in an inexpensive manner, exhibit a reduced temperature gradient in critical regions and thus, for the same structural size, have a greater load-bearing capacity.

The above object is achieved by means of the patent claims. Accordingly, the object is achieved by means of an outflow housing for a steam turbine as claimed. Furthermore, the above object is achieved by means of a steam turbine having an outflow housing according to the invention. Further features and details of the invention will emerge from the subclaims, from the description and from the drawings. Here, features and details described in conjunction with the outflow housing according to the invention self-evidently also apply in conjunction with the steam turbine according to the invention and vice versa in each case, such that with regard to the disclosure reference is always or can always be made reciprocally to the individual aspects of the invention.

According to a first aspect of the invention, the object is achieved by means of an outflow housing for a turbine stage of a steam turbine. The outflow housing has an outflow housing wall, which surrounds a central drum chamber along a housing longitudinal axis, and an attachment interface for the attachment of the outflow housing to a turbine housing of the steam turbine. According to the invention, on the outflow housing wall, there is arranged a sealing device for sealing off an end of the outflow housing with respect to a turbine shaft of the steam turbine, wherein the sealing device is sealed off with respect to the outflow housing wall.

The outflow housing is advantageously formed as a guide blade carrier. Thus, it is advantageous for multiple guide blade rings to be arranged, or arrangeable, one behind the other on the outflow housing in the direction of the housing longitudinal axis. The outflow housing has an outflow housing wall by means of which, around the housing longitudinal axis, a central drum chamber is formed. The central drum chamber may also be referred to as flow chamber and is designed for conducting a steam mass flow for driving a turbine shaft of a steam turbine. The drum chamber extends as far as the seal device and is delimited by the latter in the direction of the housing longitudinal axis. The outflow housing wall is advantageously impermeable to steam, such that impingement of the steam on a turbine housing in the region of the outflow housing is avoided. For better assemblability and disassemblability of the outflow housing, the outflow housing is advantageously formed in multiple parts, in particular with an upper part and a lower part, and is advantageously held together by way of a flange by fastening means, such as for example screws.

At a rear end of the outflow housing in a flow direction, a sealing device is arranged such that an outflow of the steam from the outflow housing is prevented by the seal device. The seal device advantageously has an outflow housing wall seal for sealing with respect to the outflow housing wall, and advantageously a turbine shaft seal for sealing with respect to a turbine shaft. It is advantageous for outflow housing wall seal and turbine shaft seal to be formed as one assembly or one component. The seal device is advantageously formed substantially in the manner of a sealing shell or at least in the manner of a seal element of a sealing shell. The seal element is advantageously formed as a lamellar seal and/or sealing lips and/or labyrinth seal. An uncontrolled outflow of steam from the outflow housing into a downstream turbine section can thus be prevented by means of the seal device.

According to the invention, the outflow housing is designed such that the steam, after flowing through the outflow housing, can be targetedly led out of the latter and fed to a reheater, without the steam impinging on the turbine housing in the process. For this purpose, correspondingly designed lines and/or channels are advantageously provided on the outflow housing.

An outflow housing according to the invention has the advantage that, by means of the outflow housing, a steam mass flow conducted through a steam turbine is kept away from the turbine housing in the region of the outflow housing and directly downstream of the outflow housing in the flow direction. A temperature gradient of the steam mass flow that arises owing to the expansion as it flows through the turbine is thus, at least at certain points, not transmitted directly to the turbine housing. An excessive thermal load on the turbine housing owing to an excessively large temperature gradient can thus be prevented. An outflow housing according to the invention can be produced inexpensively and eliminates the need for a downstream sealing shell for the purposes of preventing the steam mass flow from ingressing into a downstream turbine section. In this way, parts costs and assembly costs can be reduced. Furthermore, owing to the compact construction of the outflow housing, an overall length of a steam turbine can be reduced, in particular because the downstream sealing shell is no longer required.

In a advantageous refinement of the invention, in the case of an outflow housing, provision may be made whereby the outflow housing wall has a receiving device for receiving the sealing device. The receiving device is advantageously designed in the manner of a corresponding receiving device of a sealing shell for a steam turbine. The receiving device is advantageously designed to detachably hold the sealing device relative to the outflow housing. To receive the sealing device, the receiving device advantageously has at least one groove which runs in encircling fashion in a circumferential direction. It is advantageous for fixing means to be provided for fixing the sealing device in the receiving device. A receiving device of said type has the advantage that, using simple means, secure hold and easy exchangeability of the seal device are ensured.

It is furthermore advantageous for the outflow housing wall to have at least one outflow channel which at least partially surrounds the housing longitudinal axis. At least one outflow connector is arranged for fluid communication on the outflow channel, which at least one outflow connector extends transversely with respect to the housing longitudinal axis, advantageously at 90° and/or tangentially with respect to the outflow channel, and is designed for conducting steam. Steam that has flowed through the drum chamber of the outflow housing flows into the outflow channel and via the outflow channel into an outflow connector in order to exit the outflow housing via the outflow connector. The outflow connector is couplable to a line which is designed for conducting the steam. For example, the steam can thus be fed to a reheater of the steam turbine. This has the advantage that, with simple means, it is possible for steam that exits the outflow housing to be prevented from flowing against the turbine housing.

The sealing device is advantageously arranged on the outflow housing wall at a side, facing toward the housing longitudinal axis, of the at least one outflow channel and adjacent to the outflow channel. The sealing device is advantageously surrounded or at least partially surrounded by the outflow channel. The steam mass flow, which is prevented by the sealing device from flowing directly onward into a downstream turbine section can in this way be easily led out of the outflow housing via the outflow channel and the outflow connector. A build-up of steam between seal device and outflow channel can thus be avoided or considerably reduced.

It is furthermore advantageous for the attachment interface to be formed on an outer side, averted from the drum chamber, of the outflow housing wall. The attachment point is accordingly advantageously arranged at a region of the outflow housing which delimits the drum chamber in a radial direction. By means of the attachment interface, the outflow housing is couplable or fixable to the turbine housing. The attachment interface is formed for example as an encircling flange or web which is fixable advantageously in positively locking fashion to the turbine housing.

According to the invention, provision may be made whereby no attachment interface for the attachment of the outflow housing to the turbine housing of the steam turbine is formed on the outflow housing adjacent to the sealing device in a radial direction. An attachment interface is advantageously formed already on the outer side, averted from the drum chamber, of the outflow housing wall, such that there is no longer a need for a further attachment interface on the sealing device or on a region of the outflow housing at which the sealing device is arranged. It is thus also possible to dispense with a corresponding attachment interface on the turbine housing. In this way, production costs and assembly costs can be reduced.

It is advantageous for the attachment interface to surround or at least substantially surround the housing longitudinal axis. Such an attachment interface can be produced using simple means and inexpensively and can be easily mounted on the turbine housing.

In one advantageous embodiment of the invention, an inner side, facing toward the drum chamber, of the outflow housing wall has at least one guide blade ring. Guide blade rings are designed to divert the steam mass flow onto downstream rotor blade rings. Through the combination of the outflow housing with at least one guide blade ring, a level of outlay for the final assembly of a steam turbine can be reduced.

According to a second aspect of the invention, the object is achieved according to the invention by means of a steam turbine. The steam turbine has at least a first turbine section, a second turbine section and a turbine housing which surrounds the first turbine section and the second turbine section, wherein the first turbine section is coupled for fluid communication to the second turbine section via a reheating device. According to the invention, an outflow housing according to the invention is arranged within the turbine housing at a rear end region, in the flow direction of the steam turbine, of the first turbine section.

The first turbine section is advantageously formed as a high-pressure section and the second turbine section is advantageously formed as a medium-pressure section or low-pressure section. By means of the reheating device, a steam mass flow can, after exiting the first turbine section and before entering the second turbine section, be heated to a higher temperature level in order to thereby increase the efficiency of the steam turbine.

For the sake of assemblability, the outflow housing is advantageously of multi-part, in particular two-part, form. The outflow housing advantageously has an upper part and a lower part.

The steam turbine according to the invention has the advantage over known steam turbines that, by means of the outflow housing, it is ensured that a relatively cold steam mass flow exiting the first turbine section can be extracted from the turbine without impinging on the turbine housing in the process. During the operation of the steam turbine, a situation is thus avoided in which the turbine housing has an excessively large temperature gradient in this region, because the turbine housing is exposed substantially to relatively warm steam owing to the discharge of the relatively cold steam. Thus, the steam turbine can be less expensively dimensioned while achieving the same level of power. Alternatively, it is thus possible for a level of power of the steam turbine to be increased while maintaining the same dimensions of the steam turbine. Furthermore, the steam turbine has the advantage that an additional sealing shell which seals off the first turbine section with respect to the second turbine section is no longer necessary and can thus be omitted. In this way, the turbine shaft and thus the steam turbine as a whole can be designed to be shorter and thus less expensive. Moreover, a relatively short turbine shaft exhibits improved rotor dynamics characteristics.

It is advantageous for the outflow housing to be arranged on the steam turbine such that a steam mass flow flowing through the drum chamber can impinge on the turbine housing only after flowing through the reheating device positioned downstream of the outflow housing. For this purpose, it is advantageous for an outflow connector of the outflow housing to be coupled to the reheating device for fluid communication directly or via a line. Thus, using simple means and in an inexpensive manner, it is ensured that, instead of relatively cold steam prior to the extraction, relatively hot steam following an extraction impinges on the turbine housing. Since the steam is likewise relatively hot upstream of the outflow housing, the turbine housing is subjected to smaller temperature differences during operation. Temperature gradients of the turbine housing of a steam turbine according to the invention are thus smaller than in the case of conventional steam turbines.

The outflow housing is advantageously held on the turbine housing by means of the attachment interface. For this purpose, the turbine housing advantageously has a corresponding holding device. The attachment interface is advantageously in positively locking engagement with the holding device. For fixing purposes, the attachment interface of the outflow housing is for example screwed to the holding device of the turbine housing. The outflow housing is thus held securely on the turbine housing.

BRIEF DESCRIPTION OF THE DRAWINGS

An outflow housing according to the invention and a steam turbine according to the invention will be discussed in more detail below on the basis of drawings, in which, in each case schematically.

DETAILED DESCRIPTION OF INVENTION

Figure 1:
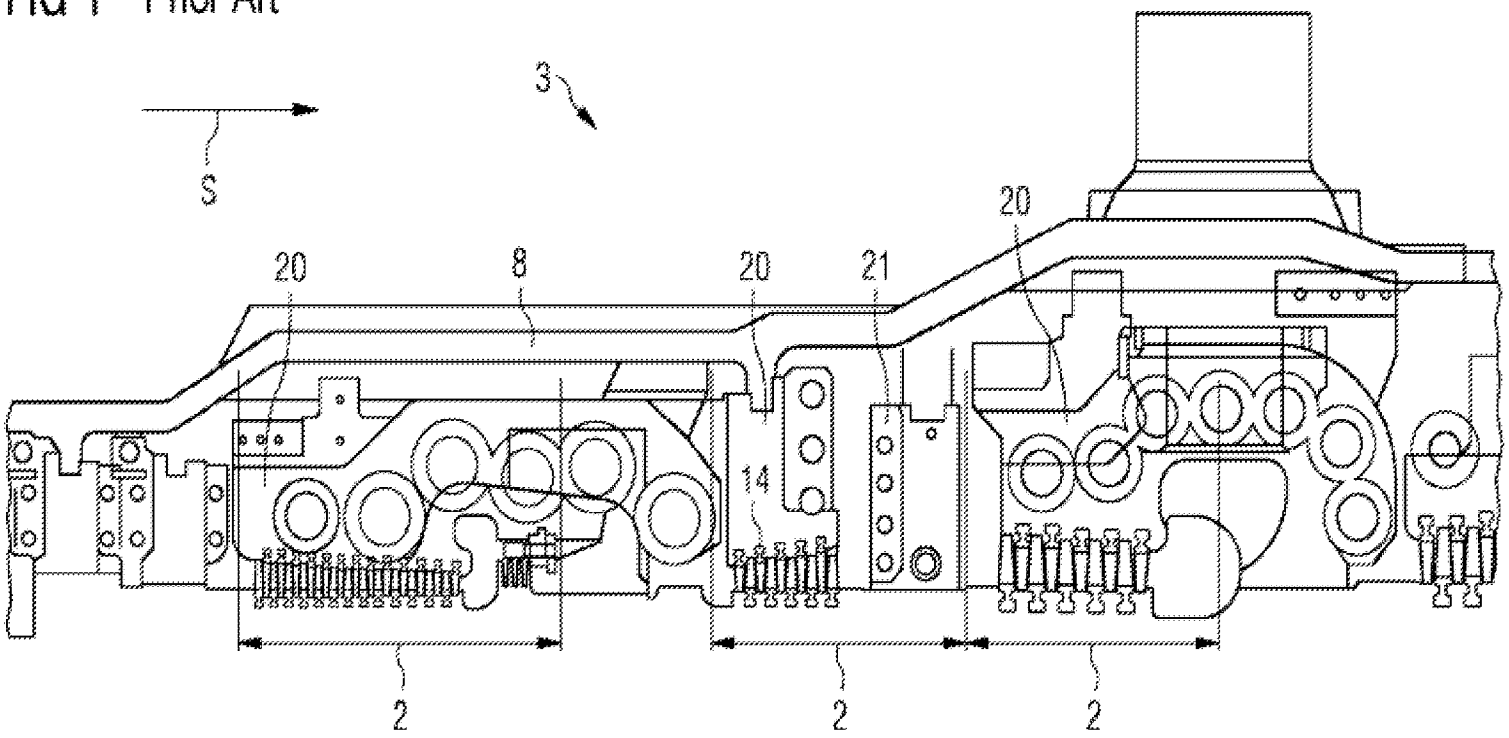
FIG 1 Prior Art
FIG. 1 shows a steam turbine according to the prior art in a side view.

FIG. 1 illustrates a steam turbine (3) according to the prior art schematically in a side view. The steam turbine 3 has multiple turbine sections 2, which are designed for example as high-pressure turbine stage, medium-pressure turbine stage and low-pressure turbine stage. In each case one guide blade carrier 20 with multiple guide blade rings 14 is arranged in the turbine sections 2. A central turbine section 2 is delimited in a flow direction S by a sealing shell 21. The sealing shell 21 prevents an onward flow of a steam mass flow in the flow direction S, and diverts said steam mass flow in the direction of the turbine housing 8 and further into an extraction device. An outlet is coupled for fluid communication to a downstream turbine section 2.

This steam turbine 3 according to the prior art has the disadvantage that, during operation, the steam mass flow that is diverted by the sealing shell 21 and which is at a relatively low temperature flows against the turbine housing 8, wherein relatively hot steam mass flows flow against the turbine housing 8 adjacently upstream and adjacently downstream in the flow direction. The turbine housing is accordingly exposed initially to a steam mass flow at a relatively high temperature, subsequently to a steam mass flow at a relatively low temperature, and finally to a steam mass flow at a relatively high temperature. This gives rise to a large temperature gradient in the turbine housing 8, which places a high load on the steam turbine 3 and limits a maximum power of the steam turbine 3.

Figure 2:
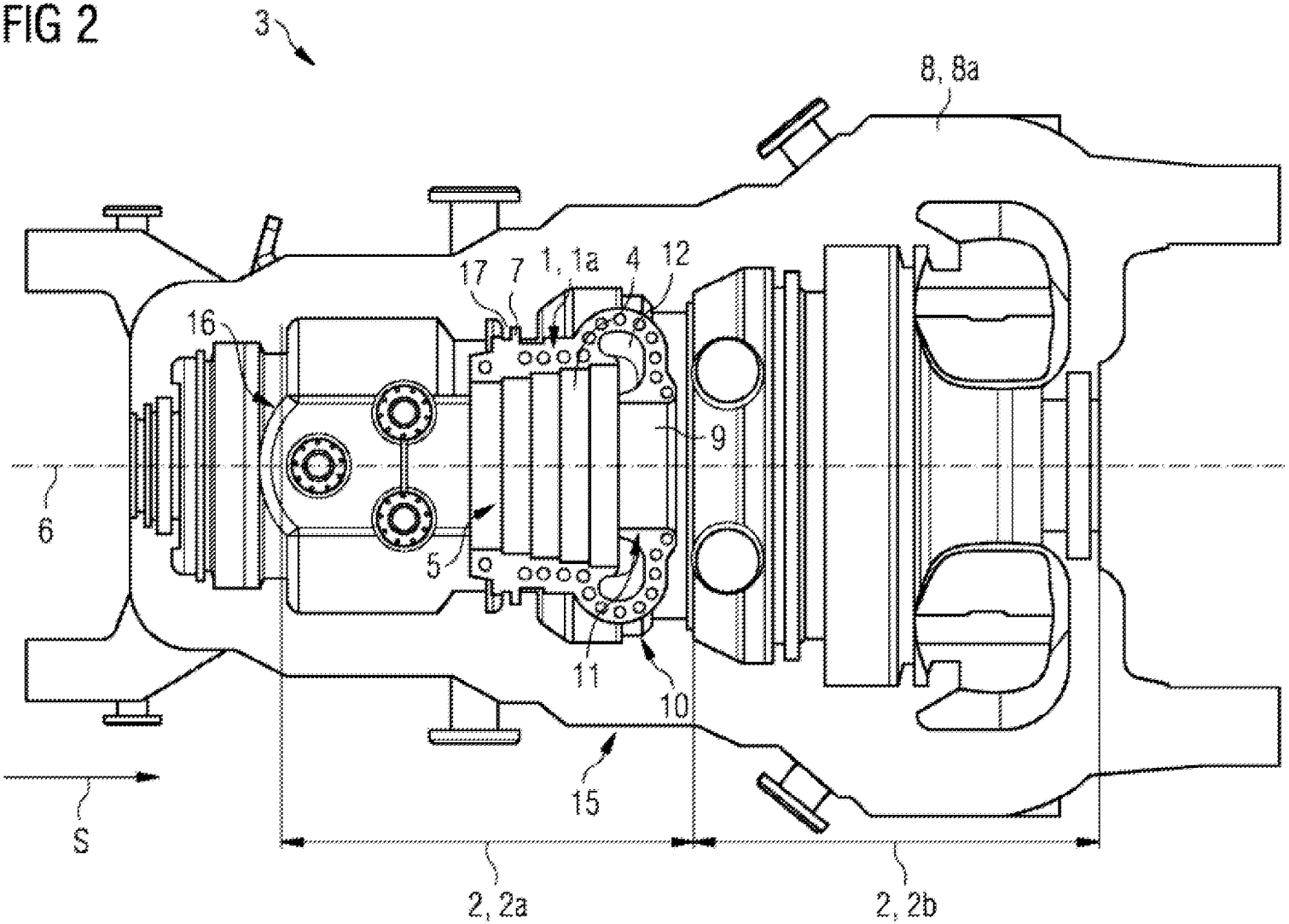
FIG. 2 shows a detail of a steam turbine according to the invention, with a lower part of an outflow housing according to the invention, in a plan view.

FIG. 2 schematically shows a detail of a steam turbine 3 according to the invention in a plan view. The steam turbine 3 has a turbine housing 8, of which only a housing lower part 8*a* is illustrated in this view. The turbine housing 8 extends along a housing longitudinal axis 6, surrounds the housing longitudinal axis 6 over a full circumference, and thus surrounds or delimits a flow chamber 16 for the throughflow of a steam mass flow. The steam turbine 3 has a multiplicity of turbine sections. An outflow housing 1 according to the invention is arranged in a rear end region 15, in the flow direction S, of a first turbine section 2*a,* which is adjacent to a second turbine section 2*b.*

The outflow housing 1 has an outflow housing wall 4, which extends along the housing longitudinal axis 6 and which surrounds the housing longitudinal axis 6 over a full circumference and which thus surrounds or delimits a central drum chamber 5 in a radial direction. Guide blade rings 14 (cf. FIG. 1) are arranged in the drum chamber 5, which guide blade rings are not illustrated in this view. An encircling attachment interface 7 is formed on an outer side, averted from the drum chamber 5, of the outflow housing wall 4. The attachment interface is, in this example, formed as an encircling flange which extends radially outward from the outflow housing wall 4. The outflow housing 1 is held or fixed by means of the attachment interface 7 on the turbine housing 8, for example by means of a screw connection. For this purpose, the turbine housing 8 has a corresponding holding device 17.

The outflow housing 1 has, in the flow direction S, a rear end 10 in which a receiving device 11 for receiving a seal device 9 is arranged. The seal device 9 is designed for sealing off the outflow housing 1 with respect to a turbine shaft (not illustrated). At the rear end 10 of the outflow housing 1, there is formed an outflow channel 12 which surrounds the housing longitudinal axis 6. A steam mass flow flowing through the drum chamber 5 is thus prevented from flowing onward in the flow direction S, and is conducted into the outflow channel 12, by the seal device 9.

Figure 3:
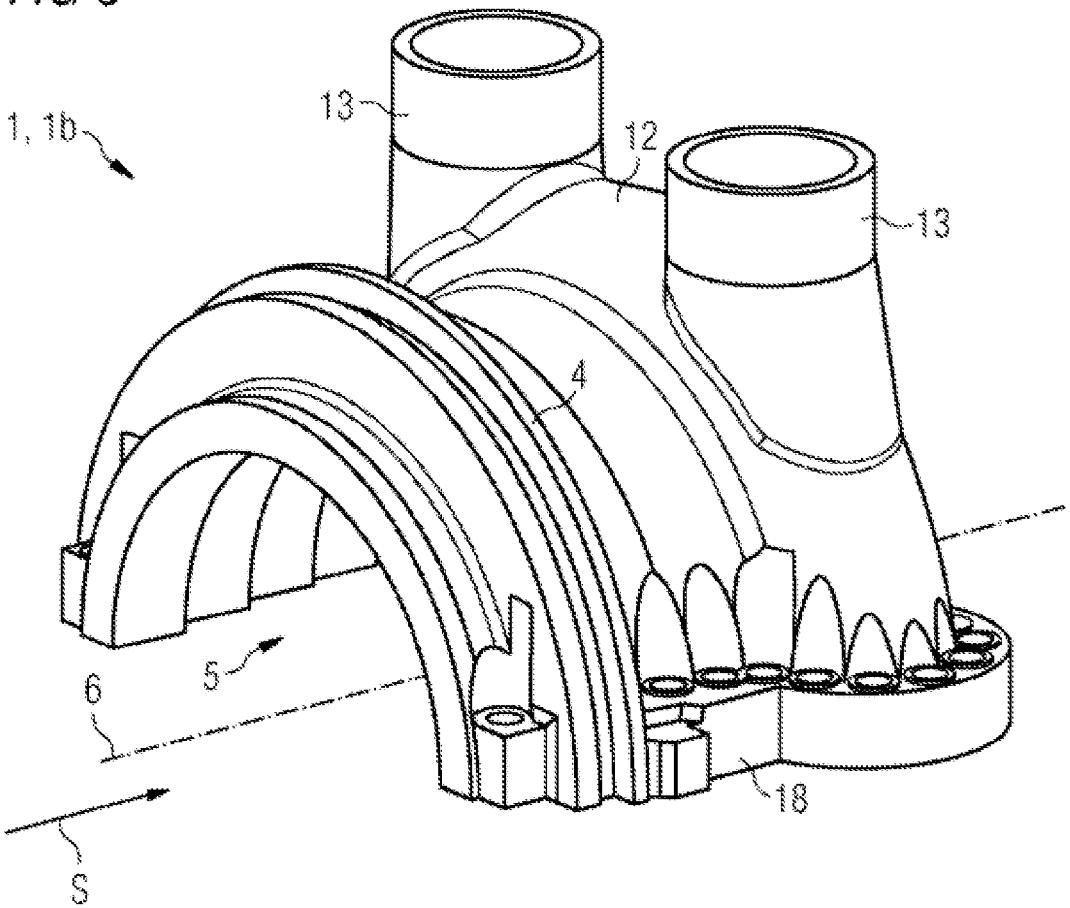
FIG. 3 shows an upper part of an outflow housing according to the invention in a perspective view.

FIG. 3 schematically shows, in a perspective illustration, an upper part 1*b* of the outflow housing 1 according to the invention from FIG. 2. Like the lower part 1*a,* the upper part 1*b* extends along the housing longitudinal axis 6, and surrounds the housing longitudinal axis 6 over 180°. By means of a connecting flange 18, the upper part 1*b* can be screwed together with the lower part 1*a*. The outflow channel 12 likewise extends in the circumferential direction over the upper part 1*b,* wherein the outflow channel 12 has, at two points, outwardly pointing openings at which there is arranged in each case one outflow connector 13, which outflow connectors extend approximately in a tangential direction from the outflow channel 12. Via the outflow connectors 13, the steam mass flow can be conducted out of the outflow housing 1 and fed into the reheating device (not illustrated), without the steam mass flow impinging on the turbine housing 8.

The invention claimed is:

1. An outflow housing for a turbine section of a steam turbine, comprising:

an outflow housing wall, which surrounds a central drum chamber along a housing longitudinal axis, and an attachment interface for attachment of the outflow housing to a turbine housing of the steam turbine, and a sealing device arranged on the outflow housing wall for sealing off a rear end, as viewed in a flow direction, of the outflow housing with respect to a turbine shaft of the steam turbine, wherein the sealing device is sealed off with respect to the outflow housing wall, wherein the outflow housing wall has at least one outflow channel which at least partially surrounds the housing longitudinal axis, and wherein at least one outflow connector is arranged for fluid communication on the outflow channel, the at least one outflow connector extends transversely with respect to the housing longitudinal axis and is designed for conducting steam away from the turbine housing.

2. The outflow housing as claimed in claim 1, wherein the outflow housing wall has a receiving device for receiving the sealing device.

3. The outflow housing as claimed in claim 1, wherein the sealing device is arranged on the outflow housing wall at a side, facing toward the housing longitudinal axis, of the at least one outflow channel and adjacent to the outflow channel.

4. The outflow housing as claimed in claim 1, wherein the attachment interface is formed on an outer side, averted from the central drum chamber, of the outflow housing wall.

5. The outflow housing as claimed in claim 4, wherein no attachment interface is formed on the outflow housing adjacent to the sealing device in a radial direction.

6. The outflow housing as claimed in claim 4, wherein the attachment interface surrounds or at least substantially surrounds the housing longitudinal axis.

7. The outflow housing as claimed in claim 1, wherein an inner side, facing toward the drum chamber, of the outflow housing wall has at least one guide blade ring.

8. A steam turbine, comprising:

a first turbine section, a second turbine section and a turbine housing which surrounds the first turbine section and the second turbine section, wherein the first turbine section is coupled for fluid communication to the second turbine section via a reheating device, and an outflow housing as claimed in claim 1 arranged within the turbine housing at a rear end region, in the flow direction of the steam turbine, of the first turbine section.

9. The steam turbine as claimed in claim 8, wherein the outflow housing is arranged on the steam turbine such that a steam mass flow flowing through the central drum chamber impinges on the turbine housing only after flowing through the reheating device positioned downstream of the outflow housing.

10. The steam turbine as claimed in claim 8, wherein the outflow housing is held on the turbine housing by the attachment interface.

* * * * *